United States Patent [19]

Kleissendorf

[11] Patent Number: 4,934,556

[45] Date of Patent: Jun. 19, 1990

[54] SEALABLE TEST STRIP CONTAINER

[75] Inventor: Roland Kleissendorf, Bergisch-Gladbach, Fed. Rep. of Germany

[73] Assignee: Miles Inc., Elkhart, Ind.

[21] Appl. No.: 295,121

[22] Filed: Jan. 9, 1989

[30] Foreign Application Priority Data

Jan. 16, 1988 [DE] Fed. Rep. of Germany ... 8800462[U]

[51] Int. Cl.[5] ..... B65D 17/34

[52] U.S. Cl. ..... 220/269; 220/276; 220/23; 215/256

[58] Field of Search ..... 220/23, 266, 268, 269, 220/270, 276, 339, 279; 215/253, 254, 255, 256, 306

[56] References Cited

U.S. PATENT DOCUMENTS

| | | | |
|---|---|---|---|
| 2,102,440 | 12/1937 | Sebell | 220/276 X |
| 2,894,654 | 7/1959 | Lohrer | 215/256 X |
| 3,499,572 | 3/1970 | Ruekberg | 220/270 |
| 3,722,188 | 3/1973 | Cullen | 220/23 X |
| 4,155,481 | 5/1979 | Takahashi et al. | 220/270 |
| 4,394,918 | 7/1983 | Grussen | 215/253 X |
| 4,475,654 | 10/1984 | Fruchter | 220/23 X |
| 4,531,650 | 7/1985 | Friendship | 215/256 |
| 4,655,363 | 4/1987 | Neat | 220/268 |
| 4,723,675 | 2/1988 | Haderer et al. | 215/253 |
| 4,840,289 | 6/1989 | Fait et al. | 220/276 X |

*Primary Examiner*—Stephen Marcus
*Assistant Examiner*—Nova Stucker
*Attorney, Agent, or Firm*—Roger N. Coe

[57] ABSTRACT

In a sealable thermoplastic plastics material container for diagnostic test strips, the lid of the container is joined to the container wall via a tear strip and via a hinge piece formed by an extension of the tear strip. The tear strip extends round the circumference of the container apart from the width of the hinge piece.

8 Claims, 1 Drawing Sheet

SEALABLE TEST STRIP CONTAINER

The invention relates to a sealable container produced from a thermoplastic material for diagnostic test strips.

Test strips for medical diagnostic purposes are supplied in containers from which they are removed as required, i.e., when a diagnostic test is being carried out. Such containers have to be user-friendly, i.e. be easily manageable and should be as inexpensive as possible. This also means that, during mechanical filling (packing) of the packaging container, it should be possible to integrate the additional procedures required into the packaging line without difficulty. In addition to these requirements, the object is, in particular, to improve the seal of the container with regard to cleanliness and hygiene on the part of the user. In particular, (a) the container should have a device which keeps it in its original state so as to produce a manufacturers guarantee of the content of the packaging; and (b) the container should invariably be re-sealed with the lid after removing test strips as the drying agent situated in the lid is extremely important for the stability of the product.

This object is achieved according to the invention in that the container lid is joined to the container wall via a tear strip and via a hinge piece forming a continuation of the tear strip, and the tear strip extends over the circumference of the container apart from the width of the hinge piece. When the tear strip is removed (first opening of the container), a small part of the tear strip therefore remains and acts as a hinge for the lid. This hinge piece prevents the lid from being set aside or from falling on the ground. Rather, the lid remains attached to the container wall in such a way that it "automatically" closes the container opening by half to two thirds after removal of a test strip owing to the restoring force of the hinge piece. The lid then only needs to be pressed on more firmly.

The width of the hinge piece is preferably about 10 to 20% of the circumference of the container. According to a development, a holding loop is also arranged on the lid opposite the hinge piece. The lid can conveniently be opened (after removal of the tear strip) using this holding loop. A thermoplastics material which is very sparingly permeable to steam is preferably used as starting material for the container.

Security during the handling of test strips is substantially increased with the novel container having an integrated seal because the lid cannot be removed from the container and damage to the drying agent in the lid by moisture is thus avoided. It has been found from experience that the container is also generally sealed again after use owing to the simplified procedure for putting on the lid. The shelf life of the test strip can be improved overall as a result of these advantages.

The invention is illustrated in more detail below with reference to an embodiment according to FIGS. 1 to 3.

Figure 1:
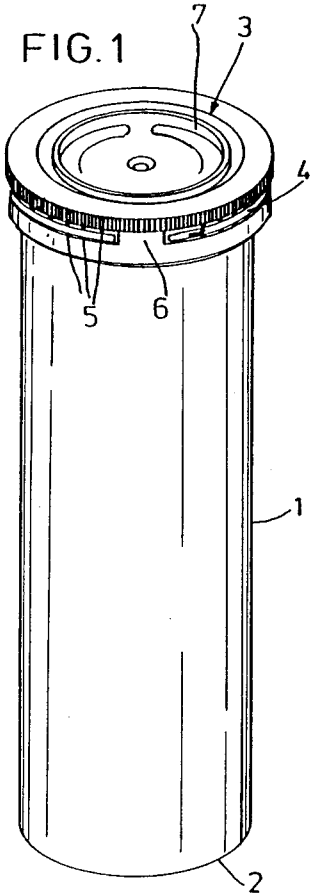
FIG. 1 shows the container with the lid in position in the original state.

The container according to FIG. 1 consists of a cylindrical container wall 1, a base 2 and a push on lid 3. As shown in FIG. 1, the lid 3 is still joined securely to the container wall 1 via a tear strip 4. The tear strip 4 has predetermined breaking points 5 on the container side and on the side facing the lid 3. When the packaging is opened for the first time, the tear strip 4 is gripped at one end and is pulled off right round. The predetermined breaking points are torn in the process. However, the tear strip 4 does not extend over the entire circumference of the container. Rather, a narrow bridge 6 remains and acts as hinge for the lid 3 (hinge piece 6). The width of the hinge piece 6 corresponds to from 5 to 30%, preferably from 10 to 20% of the circumference of the container. A holding loop 7 is fixed on the lid 3 opposite the hinge piece 6. Once the tear strip 4 has been removed, the lid 3 can conveniently be opened by pulling the holding loop 7 (see FIG. 2). The lid 3 is still attached to the container wall by means of the hinge piece 6. This prevents the lid from being mislaid when the packaging is used and subsequently being lost. It would also be particularly harmful if the lid 3 came into contact with wet spots when placed on a table or the like and would thus damage the drying agent required for the extremely moisture-sensitive test strips. The hinge piece 6 which is integral with the container wall and the lid 3 therefore contributes to an improvement in the shelf life of the product.

Figure 2:
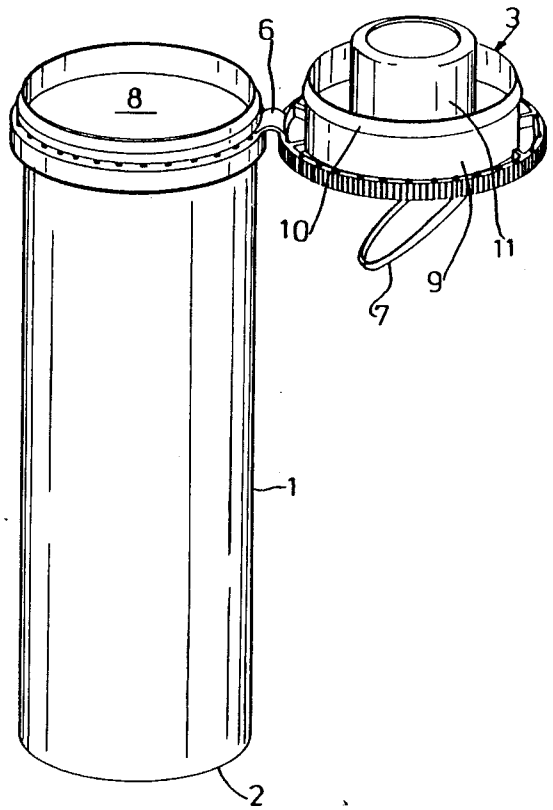
FIG. 2 shows the opened container with the lid folded back.
Figure 3:
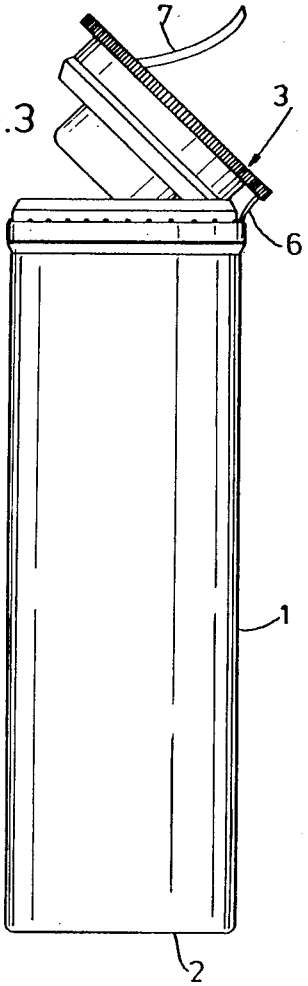
FIG. 3 shows the container in the half opened state.

The lid 3 has a flange 9 which fits exactly into the container opening 8 and is provided with an annular bead 10. A chamber 11 with the drying agent is arranged inside the flange 9. These measures ensure that the lid 3 acts as an almost steam-tight seal and that the steam partial pressure in the closed volume of the container is kept low. These precautions also have a beneficial effect in that they improve the shelf life and durability of the test strip located in the container, providing that the container is filled again in an orderly manner by pressing on the lid 3 after removing a test strip. By suitable dimensioning of the width and thickness of the hinge piece 6, the lid can be prevented from hanging outside the container opening on the hinge piece 6, as shown in FIG. 2, but rather can be made to return automatically into a half open position after opening and removal of a test strip owing to the elastic restoring force of the hinge piece 6 (see FIG. 3). After removing a test strip, the user then merely has to press the lid 3 into the container opening 8 by a single manipulation.

The entire packaging can be produced inexpensively by injection moulding from a thermoplastic material having low steam permeability, for example Lupolen®. This plastics material also has the elasticity required for the hinge piece (see above). It is obvious that the constructional features are all intended to safeguard, by improved protection from the influences of moisture, the extremely critical quality of the product during the period of use, i.e. from the moment of the initial operation on the packaging (pulling of the tear strip 4) to removal of the last test strip situated in the container, for the purpose of reliable and simplified handling.

What is claimed is:

1. A sealable container for diagnostic test strips comprising, a sealable container, produced from a thermoplastic material, having a substantially cylindrical casing wall, one open end and an annular closure lid, said sealable container being characterized in that the lid of the container is joined to the container wall via a tear strip and via a hinge piece which is integral with the container wall and which is formed by a continuation of the tear strip, said tear strip extending round the circumference of the container apart from the width of the hinge piece.

2. A container according to claim 1, characterized in that the width of the hinge piece corresponds to 5 to 30% of the circumference of the container.

3. The container of claim 2 in which the width of the hinge piece corresponds to 10 to 20% of the circumference of the container.

4. A container according to claim 1, characterized in that a chamber containing a drying agent is present in the lid.

5. A container according to claim 1, characterized in that the container, including the lid, is produced from a thermoplastic material having low permeability to steam.

6. The container of claim 1 in which a holding loop is fixed on the lid opposite the hinge piece.

7. The container of claim 1 in which the lid has a flange which fits exactly into the container to seal the container.

8. The container of claim 1 in which the lid is biased by the hinge piece toward the open end of the container.

* * * * *